US009845590B2

(12) United States Patent
Spielman

(10) Patent No.: US 9,845,590 B2
(45) Date of Patent: Dec. 19, 2017

(54) HYDRAULIC SYSTEM FOR AN EARTH MOVING MACHINE

(71) Applicant: Caterpillar Inc., Peoria, IL (US)

(72) Inventor: Michael A. Spielman, Brookfield, IL (US)

(73) Assignee: Caterpillar Inc., Peoria, IL (US)

( * ) Notice: Subject to any disclaimer, the term of this patent is extended or adjusted under 35 U.S.C. 154(b) by 187 days.

(21) Appl. No.: 14/819,853

(22) Filed: Aug. 6, 2015

(65) Prior Publication Data

US 2017/0037602 A1 Feb. 9, 2017

(51) Int. Cl.

| | |
|---|---|
| ***E02F 9/22*** | (2006.01) |
| ***E02F 3/43*** | (2006.01) |
| ***E02F 9/08*** | (2006.01) |
| *E02F 3/28* | (2006.01) |

(52) U.S. Cl.

CPC ..... *E02F 9/2292* (2013.01); *E02F 3/431* (2013.01); *E02F 9/0841* (2013.01); *E02F 9/2217* (2013.01); *E02F 9/2239* (2013.01); *E02F 9/2296* (2013.01); *E02F 3/283* (2013.01); *E02F 9/225* (2013.01)

(58) Field of Classification Search

CPC ..... F15B 15/20576; E02F 9/2292

USPC ..... 60/414, 486

See application file for complete search history.

(56) References Cited

U.S. PATENT DOCUMENTS

| | | | | |
|---|---|---|---|---|
| 3,916,624 | A * | 11/1975 | Machens | E02F 9/0841 60/394 |
| 4,449,365 | A | 5/1984 | Hancock | |
| 4,635,439 | A * | 1/1987 | Wible | B62D 5/07 60/420 |
| 6,176,083 | B1 * | 1/2001 | Ikari | E02F 9/2235 60/327 |
| 7,269,944 | B2 | 9/2007 | Zhang et al. | |
| 7,506,507 | B2 * | 3/2009 | Fransson | E02F 9/2217 60/443 |
| 8,336,232 | B2 * | 12/2012 | Patel | E02F 9/2025 37/348 |
| 8,662,816 | B2 | 3/2014 | Grimes et al. | |
| 8,756,930 | B2 | 6/2014 | Johnson et al. | |
| 8,869,520 | B2 | 10/2014 | Vigholm et al. | |
| 8,943,819 | B2 * | 2/2015 | Knussman | F15B 7/006 60/421 |
| 8,978,374 | B2 | 3/2015 | Opdenbosch et al. | |
| 9,133,780 | B2 * | 9/2015 | Asami | B60W 10/30 |
| 2008/0223631 | A1 | 9/2008 | Filla et al. | |

(Continued)

*Primary Examiner* — Thomas E Lazo

(74) *Attorney, Agent, or Firm* — Leydig, Voit & Mayer, Ltd.

(57) ABSTRACT

A hydraulic system for providing hydraulic power to the work implements and subassemblies on an earth-moving machine such as a loader includes a first hydraulic pump and a second hydraulic pump. The first hydraulic pump can be associated with a lift circuit including a lift arm that can be raised and lowered with respect to the machine. The second hydraulic pump can be associated with both a tilt circuit for tilting a bucket pivotally connected to the lift arm and a steering circuit for steering the machine. The lift circuit and the tilt and steering circuits can be operated concurrently and independently of each other due to the arrangement of the first hydraulic pump and the second hydraulic pump.

4 Claims, 2 Drawing Sheets

(56) References Cited

U.S. PATENT DOCUMENTS

| | | | | |
|---|---|---|---|---|
| 2010/0043420 | A1* | 2/2010 | Ikeda | E02F 9/2239 60/420 |
| 2011/0289908 | A1* | 12/2011 | Johnson | B62D 5/075 60/327 |
| 2013/0047599 | A1 | 2/2013 | Opdenbosch et al. | |
| 2014/0150415 | A1 | 6/2014 | Zhang et al. | |

* cited by examiner

HYDRAULIC SYSTEM FOR AN EARTH MOVING MACHINE

TECHNICAL FIELD

This patent disclosure relates generally to hydraulics and, more particularly, to a hydraulic system configured to both enable steering of an earth-moving machine and to actuate various implements disposed on the machine.

BACKGROUND

Earth-moving machines are used to move and relocate various materials and other objects about a worksite. An example of an earth-moving machine may be a loader, which may be propelled on wheels or continuous tracks, having a lift arm and bucket for lifting, transporting, and dumping material. Other possible examples of earth-moving machines may include bulldozers, dump trucks, and the like. To power the earth-moving machine, the machine may include a prime mover such as an internal combustion engine, e.g., a diesel compression ignition engine, which combusts hydrocarbon-based fuels to convert the potential chemical energy therein into a mechanical or motive force. The generated power can be utilized by a number of components on the earth-moving machine including drive components to propel the machine, steering assemblies for direction control, and work implements connected to the machine.

To distribute the generated power, the prime mover may be associated with a hydraulic system that distributes pressurized hydraulic fluid about the earth-moving machine to actuate the various components. A typical hydraulic system may include a common reservoir for containing low pressure hydraulic fluid, one or more pumps operatively coupled to the prime mover to pressurize the fluid, and a plurality of hydraulic actuators disposed about the earth-moving machine that convert fluid pressure into physical force and motion. High pressure hydraulic hoses or pipes can be included to direct the hydraulic fluid about the machine and between the hydraulic components. The components and hoses may be arranged in one or more hydraulic circuits organized to direct hydraulic fluid from the reservoir through the components and back to the reservoir for reuse.

Because the hydraulic system may include a single prime mover and possibly a common reservoir, the system needs to be designed to allocate the utilities of these common resources to meet the requirement of the different components and subassemblies on the earth-moving machine. Further, the power requirements of the earth-moving machine may change as the machine performs different operations at different times. U.S. Pat. No. 8,336,232 ("the '232 patent"), assigned to the assignee of the current application, describes an arrangement or architecture for a hydraulic system to selectively allocate the pressurized hydraulic fluid between different applications on the earth-moving. In particular, the '232 patent describes a wheel loader having a lift circuit operatively associated with the lift arm and a tilt circuit operatively associated with the bucket. A combiner valve is disposed between and in fluid communication with the lift circuit and the tilt circuit to selectively redirect hydraulic fluid between the circuits based on the requirements and capacities of the hydraulic system. The present disclosure is directed to addressing similar considerations to those described in the '232 patent.

SUMMARY

The disclosure describes, in one aspect, an earth-moving machine for loading, hauling, and dumping earth. The earth-moving machine includes a frame supported on a plurality of traction components that are steerable with respect to the frame by operation of a hydraulic steering assembly. The earth-moving machine also includes a lift arm pivotally connected to the frame and adapted to be raised and lowered with respect to the frame. A bucket is pivotally connected to the end of the lift arm and can be tilted with respect to the lift arm to dump material. To power operation of the lift arm, bucket, and hydraulic steering assembly, a first hydraulic pump is operably associated with the lift arm to actuate the lift arm and a second hydraulic pump is operably associated with both the plurality of traction components to actuate steering of the plurality of traction components and the bucket for tilting the bucket.

In another aspect, the disclosure describes a method for hydraulically operating an earth-moving machine. The method involves pressurizing low pressure hydraulic fluid into a first pressured hydraulic charge by use of a first hydraulic pump and into a second pressurized charge by use of a second hydraulic pump. The first pressurized hydraulic charge is directed to a lift circuit to raise a lift arm of the earth moving machine while the second pressurized hydraulic charge is directed to at least one of a tilt circuit operably associated with a bucket tiltable with respect to the lift arm and a steering circuit to actuate a steering assembly operably associated with a plurality of traction components that are steerable with respect to the earth-moving machine.

In yet another aspect of the disclosure, there is described a hydraulic system including a lift circuit, a tilt circuit, and a steering circuit. The lift circuit includes a first hydraulic pump in fluid communication with a first hydraulic actuator that is operably connected with a lift arm. The first hydraulic pump is adapted to direct a first pressurized hydraulic charge from the first hydraulic pump to the first hydraulic actuator. The tilt circuit includes a second hydraulic pump in fluid communication with a second hydraulic actuator operably connected to a bucket that can pivot with respect to the lift arm. The second hydraulic pump is also included as part of the steering circuit and is in fluid communication with a third hydraulic actuator operatively connected with a hydraulic steering assembly. The tilt circuit and the steering circuit are adapted to direct a second pressurized hydraulic charge from the second hydraulic pump to at least one of the second hydraulic actuator and the third hydraulic actuator.

DETAILED DESCRIPTION

Figure 1:
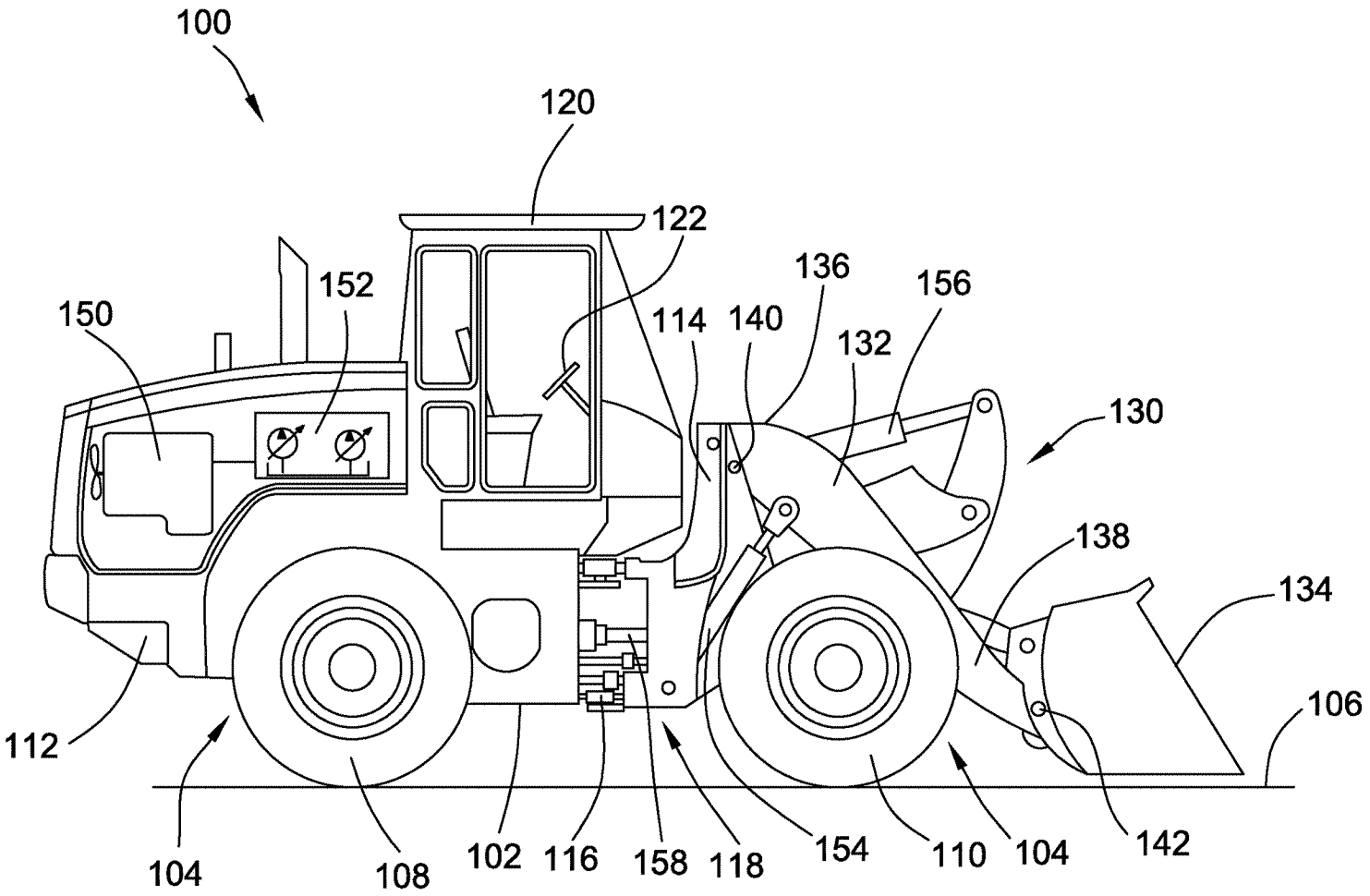
FIG. 1 is a side elevational view of a representative earth-moving machine, in particular, a wheel loader constructed in accordance with the present disclosure.

This disclosure relates to earth-moving machines that can be used for lifting, hauling, and dumping material about a worksite, such as a wheel loader, excavator, dozer, dump truck, or the like. As used herein, the term "machine" may refer to any machine that performs some type of operation associated with an industry, such as mining, construction, farming, transportation, or any other industry known in the art. Moreover, the machine may include one or more work implements connected thereto that may be utilized for a variety of tasks, including, for example, loading, compacting, lifting, brushing, and may include, for example, buckets, compactors, forked lifting devices, brushes, grapples, cutters, shears, blades, breakers/hammers, augers, and other tools. Referring to FIG. 1, wherein like reference numbers refer to like elements, there is illustrated an embodiment of an earth-moving machine in the form of a loader 100.

The loader 100 may be of the wheeled variety in which the frame 102 of the loader is supported by a plurality of traction components 104 that contact the ground or work surface 106 of the worksite. In the illustrated embodiment, the plurality of traction components 104 can be wheels that are rotatable with respect to the frame 102 of the loader 100 by way of bearing assemblies. The wheels can be further categorized as drive wheels 108 that are power-driven to propel the loader 100 over the work surface 106 and steer wheels 110 that can turn to change the direction of travel of the loader. The frame 102 can be an articulated frame with a two-part construction including a rear end 112 and a front end 114 that are connected together by an articulating joint 116 to enable the rear and front ends to pivot with respect to each other. The drive wheels 108 may be disposed on the rear end 112 of the loader 100 and the steer wheels 110 may be disposed on the front end 114 to form part of a hydraulic steering assembly 118. When suitably directed, the steer wheels 110 may pivot the front end 114 of the frame 102 with respect to the rear end 112 to turn the loader 100. In other embodiments, however, the frame 102 may be a unitary design with the steer wheels 110 associated with a hydraulic steering assembly of a different configuration to turn the steer wheels with respect to the frame, or the loader 100 may be supported on different types of traction components 104 altogether, such as continuous tracks.

To accommodate an operator responsible for directing and controlling operation of the loader 100, an operator station 120 may be supported on the frame 102 in an elevated position. Disposed in the operator station 120 proximate to the operator may be one or more operator interface devices, such as a steering wheel, joysticks, levers, knobs, pedals, switches, or other devices used to direct operation of the loader 100. In particular, the operator interface devices 122 may be used to direct propulsion and maneuver the loader 100 with respect to the work surface 106 and to operate any work implements associated with the loader. As the operator moves or manipulates an operator interface device 122, the device may affect a corresponding motion or action by the loader in a desired direction, or with a desired speed or force. The operator station 120 may also include one or more displays, screens, dials, gauges, and the like to provide the operator with information about the operation of the loader and its components.

For performing operations about the worksite, the loader 100 includes one or more work implements 130 connected to the frame 102. For example, the work implement 130 may be a lift arm 132 and a bucket 134 to lift, haul, and dump materials. The lift arm 132 may be an elongated, rigid structure extending between a first end 136 and a second end 138. The lift arm 132 may be pivotally connected to the front end 114 of the frame 102 at its first end 136 by a first pivot joint 140 so that it may be pivotally raised and lowered with respect to the frame 102 and the work surface 106. The bucket 134 can be pivotally connected to the distal second end 138 of the lift arm 132 by a second pivot joint 142 and configured to tilt with respect to the lift arm. Hence, when the lift arm 132 is lowered and the bucket 134 engages the work surface 106, the loader 100 can be moved in the forward direction to fill the bucket with material. The lift arm 132 can then be raised to disengage the bucket 134 from the work surface 106 so the loader 100 can haul the material therein about the worksite. The bucket 134 can be tilted with respect to the lift arm 132 to dump the material at a desired location. The lift arm 132 may be shaped to support the weight of the bucket 134 in a cantilevered manner and, in an embodiment, two lift arms may be provided that are pivotally connected to either side of the bucket for improved support. Examples of other work implements include booms, blades, shovels, and the like.

To generate power for maneuvering the loader 100 and for operating the work implements 130, the loader can include a power system based around a prime mover 150 disposed on the rear end 112 of the frame 102. As indicated above, the prime mover 150 can be an internal combustion engine, e.g., a diesel compression ignition engine, which combusts a hydrocarbon-based fuel to convert the potential energy therein into usable mechanical or motive forces, typically embodied by a rotating output shaft or drive shaft protruding from the engine. The prime mover 150 can be mechanically connected to the drive wheels 108 through transmissions, differentials, and the like to forcibly rotate the drive wheels 108 with respect to the frame 102. However, to enable the work implements and other components disposed about the loader 100 at locations remote from the prime mover 150 to utilize the generate mechanical power, the loader can be associated with a hydraulic system 152 that uses the motion to pressurize a hydraulic fluid. The pressurized hydraulic fluid can be directed to or circulated to the work implements 130 where, for example, the hydraulic pressure can be used to power one or more hydraulic actors associated with the work implements.

For example, to raise and lower the lift arm 132 with respect to the frame 102, the pressured hydraulic fluid can power a first hydraulic actuator 154 operatively connected between the lift arm 132 and the front end 114 of the frame. The first hydraulic actuator 154 can extend and retract in a telescoping manner to cause the lift arm 132 to pivot with respect to the first pivot joint 140 to raise and lower the bucket 134. Likewise, to tilt the bucket 134 with respect to the frame 102, a second hydraulic actuator 156 can be operatively connected between the bucket and the lift arm 132 and can also extend and retract to pivot the bucket about the second pivot joint 142. In the present embodiment, the hydraulic system 152 can also be associated with a third hydraulic actuator 158 that is part of the hydraulic steering assembly 118 to pivot the front end 114 with respect to the rear end 112 of the loader to enable steering of the loader. In other embodiments, the third hydraulic actuator 158 may be associated with different types of steering assemblies such as rack-and-pinion designs. Of course, other work implements, sub-assemblies, and hydraulic devices, and any associated hydraulic actuators may be operatively associated with the hydraulic system 152.

Figure 2:
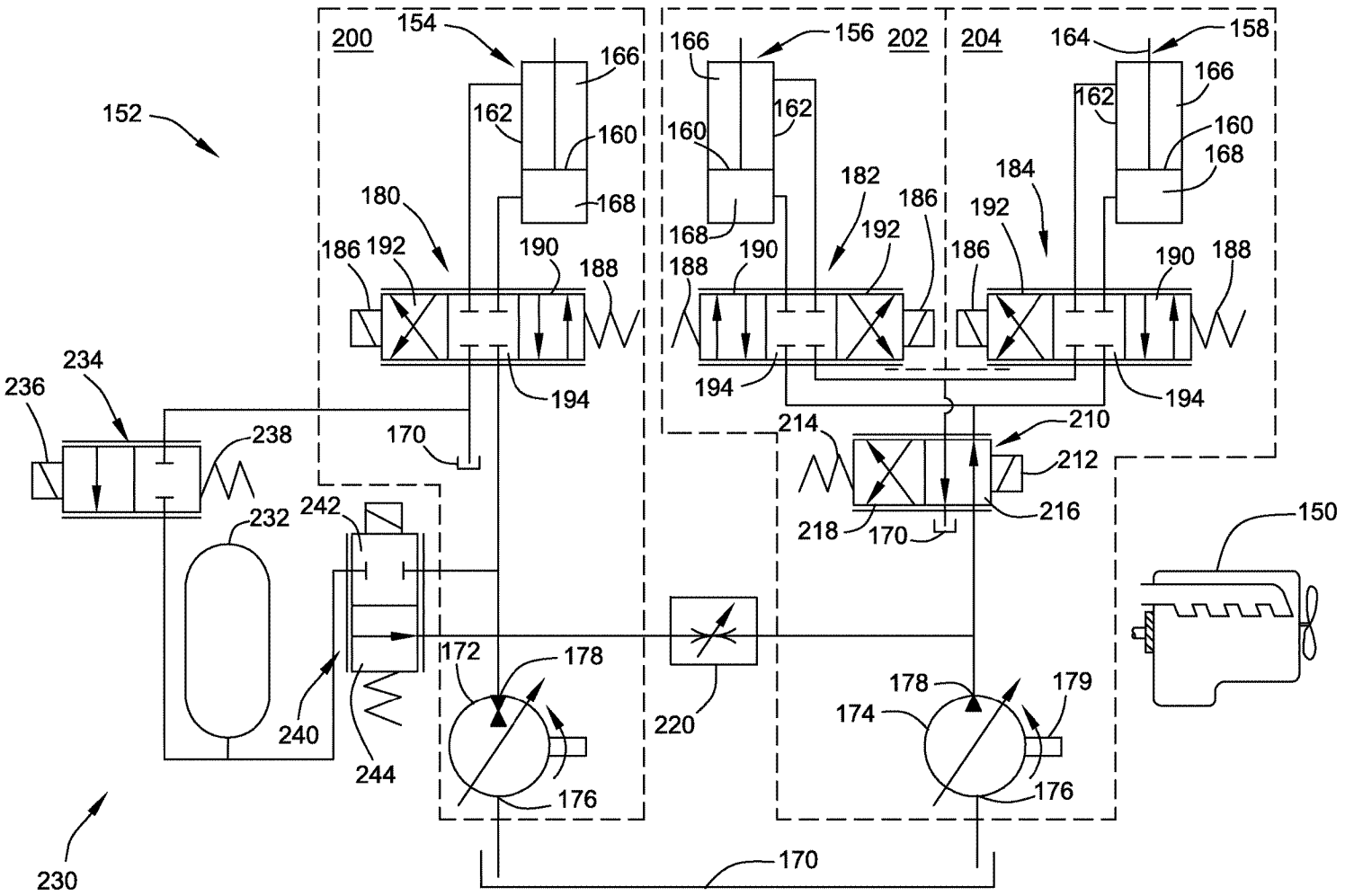
FIG. 2 is a schematic diagram of a hydraulic system for operating the sub-assemblies and components of the wheel loader of FIG. 1 in accordance with the present disclosure.

Referring to FIG. 2, which shows a schematic representation of the components of the hydraulic system 152, the first hydraulic actuator 154, the second hydraulic actuator 156, and the hydraulic actuator 158 can, in various embodiments, be double acting hydraulic cylinders. The hydraulic cylinder includes a piston 160 slidably received in an enclosed housing or barrel 162 and disposed to reciprocate back and forth within the barrel. The piston 160 and barrel 162 may be circular or cylindrical in shape to facilitate relative sliding movement between the parts. The piston 160 can include a rod 164 extending from one side of the piston that protrudes from the enclosed barrel 162 to connect with the work implement or frame. Further, the piston 160 can divide the internal volume of the barrel 162 into a head end 166 corresponding to the side of the piston from which the rod 164 extends and a cap end 168 corresponding to the side of the piston 160 opposite the rod. The head end 166 and the cap end 168 can communicate with respective ports disposed through the barrel 162 to receive and discharge hydraulic fluid from the volume defined by the barrel. If pressurized hydraulic fluid is directed into the cap end 168 of the barrel 162, it can force the piston to slide toward the head end 166 causing the rod 164 to protrude farther out of the barrel 162. Conversely, if pressurized hydraulic fluid is directed into the head end 166, the piston 160 moves toward the cap end 168 retracting the rod 164 into the barrel 162. Although only one hydraulic cylinder is shown associated with each of the lift arm 132, bucket 134, and steering assembly 118, it should be appreciated that in other embodiment multiple cylinders may be associated with each of the devices. In other embodiments, the hydraulic actuators may include pistons of a different construction or operation or may be different actuation devices such as hydraulic motors or the like.

To supply the hydraulic fluid that actuates the hydraulic actuators, the hydraulic system 152 can include a tank or hydraulic reservoir 170. The hydraulic reservoir 170 contains a volume of relatively low pressure hydraulic fluid and may be vented to the atmosphere or may be enclosed so that the contents can be maintained in a slightly pressurized state. The hydraulic fluid can be any suitable type of incompressible fluid such as lubrication oil or the like and may have a sufficient viscosity to enable the fluid to readily flow in the hydraulic system. As indicated in the schematic, the hydraulic reservoir 170 may be disposed at a lower relative elevation compared to the other components of the hydraulic system 152 so the hydraulic reservoir 170 can function as a sump to which the system returns and collects the hydraulic fluid. To facilitate its use on the mobile loader 100 and to simplify filling and fluid replacement, a single hydraulic reservoir 170 may be include with the hydraulic system 152 but in other embodiments, multiple smaller reservoirs may be include.

To pressurize and direct hydraulic fluid from the hydraulic reservoir 170 to and from the first, second, and third hydraulic actuators 154, 156, 158, the hydraulic system 152 can include a first hydraulic pump 172 and a second hydraulic pump 174. The first and second hydraulic pumps 172, 174 may be any suitable type of pump for pressurizing and positively displacing hydraulic fluid to flow in a circuit, including piston pumps, rotary gear pumps, vane pumps, gerotor pumps, swash plates, and the like. The first and second hydraulic pumps 172, 174 may be fixed displacement pumps or, as indicated, variable displacement pumps capable of changing or adjusting the output volume or flow rate the pump. The first and second hydraulic pumps 172, 174 can include an inlet 176 in fluid communication with the hydraulic reservoir 170 to receive or draw low pressure hydraulic fluid and an outlet 178 from which the pressurized hydraulic fluid is discharged. In various embodiments, the first and second hydraulic pumps 172, 174 may be reversible to enable hydraulic flow both to and from the hydraulic reservoir 170. To drive the pumps, the first and second hydraulic pumps 172, 174 may be coupled to the driveshaft of the prime mover 150 by, for example, a respective pump shaft 179 as indicated.

To selectively direct and control the flow of pressurized hydraulic fluid to and from the hydraulic actuators, the hydraulic system 152 may include one or more flow control or direction control valves. In a illustrated embodiment, each of the first, second, and third hydraulic actuators 154, 156, 158 can be associated with a first flow control valve 180, a second flow control valve 182, and a third flow control valve 184, respectively. To regulate flow of hydraulic fluid to the hydraulic actuators, the flow control valves 180, 182, 184 can be positioned between the respective hydraulic actuators and the first and second hydraulic pumps 172, 174 and in fluid communication with the actuators and pumps. The flow control valves 180, 182, 184 may be three-position, two-way valves that can selectively direct pressurized hydraulic fluid to or from the head end 166 or the cap end 168 of the respective hydraulic actuator to facilitate moving the piston 160 inside the barrel 162. In an embodiment, the flow control valves 180, 182, 184 may be solenoid operated spool valves including an electromagnetic solenoid 186 for changing the position of an internal spool biased against a spring 188. When the solenoid 186 is electromagnetically activated, the solenoid moves or configures the spool to unseal and seal various ports in the respective flow control valve that directs fluid to and from the actuator moving the piston 160 and rod 164 in a manner that actuates the associated work implement.

In the illustrated example, the three-position flow control valves 180, 182, 184 may include a first position 190 in which the internal spool is moved to direct hydraulic fluid to the cap end 168 and remove hydraulic fluid from the head end 166 to facilitate double action of the respective actuator. The flow control valves 180, 182, 184 can also include a second position 192 in which hydraulic fluid is directed to the head end 166 and removed from the cap end 168 to facilitate two-way flow. The flow control valves 180, 182, 184 may also include a neutral third position 194 in which hydraulic flow to the respective hydraulic actuator is cut off and the hydraulic actuator is isolated from the rest of the hydraulic system 152. The neutral third position may lock and hold the hydraulic actuator and its associated work implement in an intermediate position. In other embodiments, the flow control valves 180, 182, 184 may be of a different construction such as a two-position valves, three-way valves, pilot actuated valves, etc. In the schematic shown in FIG. 2, to direct hydraulic fluid between the various pumps, valves, and actuators, the solid lines between those components represent hydraulic lines, hoses, or tubes per convention.

To direct and allocate the hydraulic fluid from the common hydraulic reservoir 170 to the first, second, and third hydraulic actuators 154, 156, 158, using the first and second hydraulic pumps 172, 174, the hydraulic system 152 can be configured into a plurality of distinct hydraulic circuits. For example, the first hydraulic actuator 154 that is operatively connected to the lift arm can be associated with a lift circuit 200 as indicated by the dashed lines. The first hydraulic pump 172 can also be associated with the lift circuit 200 and is primarily dedicated to providing pressurized hydraulic fluid to the first hydraulic actuator 154. Accordingly, the first hydraulic pump 172 is in direct fluid communication with the first flow control valve 180 that is associated with the first hydraulic actuator 154. The first hydraulic pump 172 and the first hydraulic actuator 154 can form an independent and isolated lift circuit 200 so that a first pressurized hydraulic charge generated by the first hydraulic pump may be exclusively directed to the first hydraulic actuator. Additional circuits can include a tilt circuit 202 associated with the second hydraulic actuator 156 that is operatively connected to the bucket and a steering circuit 204 operatively associated with the third hydraulic actuator 158 that is operatively associated with the hydraulic steering assembly. To provide pressurized hydraulic fluid to the tilt circuit 202 and the steering circuit 204, the second hydraulic pump 174 can be in fluid communication with both the tilt circuit 202 and the steering circuit 204 and is primarily dedicated to pressurizing and directing hydraulic fluid to the second hydraulic actuator 156 and the third hydraulic actuator 158 of those circuits respectively. Hence, a second pressurized hydraulic charge generated by the second hydraulic pump 174 may be exclusively directed to the second and third hydraulic actuators 156, 158.

To enable the second hydraulic pump 174 to selectively direct pressurized hydraulic fluid to both the tilt circuit 202 and the steering circuit 204, a direction control valve 210 can be disposed between and communicate with the second hydraulic pump 174 and the second and third flow control valves 182, 184. The direction control valve 210 may be a two-position, two-way valve which can control the direction of flow of the pressurized hydraulic fluid from the second hydraulic pump 172 and back to the hydraulic reservoir 170. The direction control valve 210 may include an electromagnetically activate solenoid 212 and a biasing spring 214 that can move or configure an internal spool of the valve between a first position 216 and a second position 218 to selectively change the flow direction of the hydraulic fluid. The direction control valve 210, when operated in conjunction with the second and third flow control valve 182, 184, can introduce or remove hydraulic fluid from either the head end 166 or cap end 168 of either the second or the third hydraulic actuators 156, 158 to selectively extend or retract the respective rod 164. Hence, the bucket associated with the second hydraulic actuator 156 and the hydraulic steering assembly associated with the third hydraulic actuator 158 can be operated independently of each other with pressurized hydraulic fluid from the second hydraulic pump 172.

As illustrated in FIG. 2, the lift circuit 200 and the tilt and steering circuits 202, 204 are generally independent and isolated from each other with each having an independent source of pressurized fluid due to the distinct and dedicated arrangement of the first hydraulic pump 172 and the second hydraulic pump 174. In an embodiment, the work requirements of a particular circuit may be of a magnitude that the respective first or second hydraulic pumps 172, 174 are unable to provide the required pressure, quantity, or flow rate of hydraulic fluid. To address such circumstances, the hydraulic system 152 can be configured so that the first hydraulic pump 172 and the second hydraulic pump 174 can cooperate to combine their respective fluid outputs. A combiner valve 220 can be disposed between the lift circuit 200 and the tilt and steering circuits 202, 204, downstream of the outlets 178 of the first hydraulic pump 172 and the second hydraulic pump 174 and in fluid communication with both pumps. The hydraulic lines to and from the combiner valve 220 hence function as a bridge between the lift circuit 200 and the tilt and steering circuits 202, 204. The combiner valve 220 can be an adjustable restrictor that can be selectively adjusted from a setting preventing any flow and isolating the circuits to a setting allowing substantially unimpeded flow between the circuits. When operated in conjunction with the selective opening and closing of the first, second, and third flow control valves 180, 182, 184, the combiner valve 220 can direct hydraulic fluid from the first hydraulic pump 172 to the tilt and steering circuits 202, 204, or can direct hydraulic fluid from the second hydraulic pump 174 to the lift circuit 200. The first and second hydraulic pumps 172, 174 can assist each other in providing pressurized hydraulic fluid as required by their respective circuits by operation of the combiner valve 220.

To further leverage the capacities of the hydraulic system 152, an energy recovery system 230 can be included to recover and recycle the potential energy of the pressurized hydraulic fluid from at least one of the first, second, and third hydraulic actuators 154, 156, 158. The energy recovery system 230 can include an accumulator 232, which may be a pressure tank of a particular volume into which pressurized hydraulic fluid from one of the hydraulic actuators can be directed for temporary retention. In other words, instead of returning pressurized hydraulic fluid from a hydraulic actuator to the hydraulic reservoir 170, the accumulator 232 can hold pressurized hydraulic fluid temporarily for reuse in the hydraulic system 152. To redirect the pressurized hydraulic fluid to the accumulator 232, a charge valve 234 can be disposed in fluid communication with at least the first flow control valve 180 associated with the first hydraulic actuator 154. The charge valve 234 can be a two-position, one-way valve including a solenoid 236 and a spring 238 for selectively switching between opened and closed positions. The charge valve 234 can be located upstream of the accumulator 232 so that, when the charge valve is opened, pressurized hydraulic fluid from the first hydraulic actuator 154 flows to the accumulator.

To recycle the pressurized hydraulic fluid contained in the accumulator 232, a discharge valve 240 can be disposed downstream of the accumulator and in fluid communication with, for example, the inlets 176 of the first hydraulic pump 172 and the second hydraulic pump 174. The discharge valve 240 can be a two-position, one-way valve having a first opened position 242 and a second closed position 244. When the discharge valve 240 is in the second closed position 244, the discharge valve isolates the accumulator 232 and retains the pressurized hydraulic fluid therein. However, if the discharge valve 240 is moved to the first opened position 242, the discharge valve puts the accumulator 232 in fluid communication with the lift circuit 200 downstream of the first hydraulic pump 172 so that hydraulic fluid contained in the accumulator can flow to the lift circuit. The pressurized hydraulic fluid can assist the first hydraulic pump 172 in pressurizing low pressure hydraulic fluid from the hydraulic reservoir 170, reducing the work expended by the first hydraulic pump and enabling the pressurized hydraulic fluid to be reused in the lift circuit 200. Likewise, if the discharge valve 240 is placed in the second opened position 244, the discharge valve can direct pressurized hydraulic fluid from the accumulator to the tilt and steering circuits 202, 204 across the combiner valve 220 to assist the second hydraulic pump and the associated tilt and steering circuits.

INDUSTRIAL APPLICABILITY

The present disclosure is applicable to a hydraulic system 152 to operate multiple work implements 130, components, and sub-assemblies on an earth-moving machine such loader 100. Referring to FIGS. 1 and 2, the work implements 130 may include a lift arm 132 for raising and lowering a bucket 134 that is configured to tilt with respect to the lift arm to hold or dump material. Other hydraulically powered assemblies may include a hydraulic steering assembly 118 operatively associated with traction components 104 for changing the direction of travel of the loader. To pressurize and distribute pressurized hydraulic fluid to actuate these implements and sub-assemblies, the hydraulic system 152 can be configured as a plurality of distinct, separate hydraulic circuits primarily served by either the first hydraulic pump 172 or the second hydraulic pump 174 and arranged to beneficially allocate and utilize the components and resources of the hydraulic system.

For example, the lift arm 132 is associated with a distinct lift circuit 200 for supplying pressurized hydraulic fluid to a first hydraulic actuator 154 operatively connected to the lift arm. The first hydraulic pump 172 can be dedicated to generating and directing a first pressurized hydraulic charge to the first hydraulic actuator to raise and lower the lift arm 132. The bucket 134 and the hydraulic steering assembly 118 are associated with a respective tilt circuit 202 and steering circuit 204 which are partially combined and overlap certain utilities. In particular, the second hydraulic pump 174 can be primarily dedicated to generating and directing a second pressurized hydraulic charge to at least one of the second hydraulic actuator 156 associated with the bucket 134 or the third hydraulic actuator 158 associated with the hydraulic steering assembly 118. The first hydraulic pump 172 and the second hydraulic pump 174, while physically separated and independently operable with respect to each other, can be in fluid communication with a common hydraulic reservoir 170 containing low pressure hydraulic fluid and can be coupled to the same prime mover 150 to receive motive power. Separating the hydraulic system 152 into distinct circuits at the first and second hydraulic pumps 172, 174, enables the hydraulic system to leverage the common resources of the hydraulic reservoir 170 and the prime mover 150, facilitates conservation of hydraulic fluid, and enables independent and selective operation of the first and second hydraulic pumps to improve performance of the associated circuits.

For example, a possible advantage of the foregoing arrangement is the performance improvements from partially combining the tilt and steering circuits 202, 204. The loader 100, in normal operation, will typically not actively adjust the hydraulic steering assembly 118 and tilt the bucket 134 at the same time. Because the two devices are typically not used concurrently, the second pressurized hydraulic charge from the second hydraulic pump 174 can be selectively directed to either the second hydraulic actuator 156 associated with the bucket 134 or third hydraulic actuator 158 associated with the hydraulic steering assembly 118 as appropriate. This allows for a reduction in size or capacity of the second hydraulic pump 174. If, on occasion, the hydraulic steering assembly 118 and bucket 134 are used concurrently in a manner overwhelming the second hydraulic pump 174, the combiner valve 220 can be opened to direct a portion of the first pressurized hydraulic charge output from the first hydraulic pump 172 to assist the second hydraulic pump 174 with actuating the second and third hydraulic actuators 156, 158.

Associating the lift arm 132 as a separate lift circuit 200 with the first hydraulic pump 172 dedicated thereto further improves the hydraulic system 152 by enabling the lift arm to operate concurrently with either the hydraulic steering assembly 118 or the bucket 134. Additionally, raising and lowering the lift arm 132 may require more power than adjusting the hydraulic steering assembly 118 or tilting the bucket 134. The required power may be provided more easily by exclusively directing the first pressurized hydraulic charge from the first hydraulic pump 172 to the first hydraulic actuator 154. In the event additional power is required, the combiner valve 220 can be opened to redirect a portion of the second pressurized hydraulic charge output from the second hydraulic pump 174 to the first hydraulic actuator 154 to assist in raising the lift arm 132.

The distinct arrangement the lift circuit 200 also facilitates energy recovery by the energy recovery system 230. For example, the first hydraulic pump 172 raises the lift arm 132 by exclusively directing the first pressurized hydraulic charge to the cap end 168 of the first hydraulic actuator 154, thereby extending the rod 164 to which the lift arm is operatively connected. To lower the lift arm, the first flow control valve 180 is repositioned to discharge the first hydraulic charge from the first hydraulic actuator 154 thereby allowing the lift arm to descend with respect to the frame under its own weight. Rather than direct the first hydraulic charge, still under relatively high pressure, to the hydraulic reservoir 170, the charge valve 234 can be opened to direct the first pressurized hydraulic charge to the accumulator 232 where it can be temporarily maintained. In addition, the charge valve 234 can be configured to establish a pressure drop that impedes the first hydraulic charge from exiting the first hydraulic actuator 154 too quickly and therefore allows the lift arm 132 to lower at a suitable rate. When stored fluid pressure is needed, the discharge valve 240 can be selectively configured to direct the first pressurized hydraulic charge from the accumulator 232 to downstream of the outlets 178 of the first hydraulic pump 172 and/or second hydraulic pump 174, hence recovering and recycling a portion of the energy already expended by the hydraulic system 152.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

I claim:

1. An earth-moving machine comprising:

a frame supported on a plurality of traction components that are steerable with respect to the frame by operation of a hydraulic steering assembly;

a lift arm pivotally connected to the frame, the lift arm adapted to be raised and lowered with respect to the frame; and a bucket pivotally connected to the lift arm, the bucket adapted to be tilted with respect to the lift arm;

a first hydraulic pump operably associated with the lift arm to actuate the lift arm;

a second hydraulic pump operably associated with both the plurality of traction components to actuate steering of the plurality of traction components and the bucket for tilting the bucket;

a first hydraulic actuator operably connect to the lift arm and in fluid communication with the first hydraulic pump;

a second hydraulic actuator operably connected with the bucket for pivotally tilting the bucket;

a third hydraulic actuator operably associated with the hydraulic steering assembly to actuate steering of the plurality of traction components;

the second hydraulic actuator and the third hydraulic actuator both in fluid communication with the second hydraulic pump; and an energy recovery system including a charge valve and an accumulator, the charge valve operably connected with and configured to establish fluid communication between the first hydraulic actuator and the accumulator;

wherein the energy recovery system further includes a discharge valve operably connected with and configured to establish fluid communication between the accumulator and at least one of the first hydraulic pump and the second hydraulic pump.

2. A method of hydraulically operating an earth-moving machine comprising:

pressurizing by a first hydraulic pump low pressure hydraulic fluid into a first pressured hydraulic charge;

pressurizing by a second hydraulic pump low pressure hydraulic fluid into a second pressurized hydraulic charge;

directing the first pressurized hydraulic charge to a lift circuit to raise a lift arm of the earth-moving machine;

directing the second pressurized hydraulic charge to at least one of a tilt circuit operably associated with a bucket tiltable with respect to the lift arm of the earth-moving machine and a steering circuit to actuate a steering assembly operably associated with a plurality of traction components that are steerable with respect to the earth-moving machine;

directing at least a portion of the first pressurized hydraulic charge from the lift circuit to an accumulator; and directing the portion of the first pressurized hydraulic charge from the accumulator to at least one of the first hydraulic pump and the second hydraulic pump.

3. A hydraulic circuit comprising:

a lift circuit including a first hydraulic pump in fluid communication with a first hydraulic actuator operably connected with a lift arm, the lift circuit adapted to direct a first pressurized hydraulic charge from the first hydraulic pump to the first hydraulic actuator;

a tilt circuit including a second hydraulic pump in fluid communication with a second hydraulic actuator operably connected to a bucket pivotally connected to the lift arm;

a steering circuit including the second hydraulic pump in fluid communication with a third hydraulic actuator operatively connected with a hydraulic steering assembly;

the tilt circuit and the steering circuit adapted to direct a second pressurized hydraulic charge from the second hydraulic pump to at least one of the second hydraulic actuator and the third hydraulic actuator;

an energy recovery system including a charge valve and an accumulator, the charge valve operably connected with and configured to establish fluid communication between the first hydraulic actuator and the accumulator;

wherein the energy recovery system further includes a discharge valve operably connected with and configured to establish fluid communication between the accumulator and at least one of the first hydraulic pump and the second hydraulic pump.

4. The hydraulic circuit of claim 3, further comprising a combiner valve in fluid communication with the first hydraulic pump and the second hydraulic pump to selectively direct the first pressurized hydraulic charge to at least one of the steering circuit and the tilt circuit and to selectively direct the second pressurized hydraulic charge to the lift circuit.

* * * * *